US006810805B1

(12) United States Patent
Atwater

(10) Patent No.: US 6,810,805 B1
(45) Date of Patent: Nov. 2, 2004

(54) INK PUMP WITH ROTATING RECIPROCATING PUMP AND ROTARY VALVE

(76) Inventor: Richard G. Atwater, 112 Smith Ave., Rockford, IL (US) 61107

( * ) Notice: Subject to any disclaimer, the term of this patent is extended or adjusted under 35 U.S.C. 154(b) by 0 days.

(21) Appl. No.: 10/683,319

(22) Filed: Oct. 10, 2003

Related U.S. Application Data

(63) Continuation-in-part of application No. 10/461,147, filed on Jun. 13, 2003.

(51) Int. Cl.[7] ..... B41F 31/08

(52) U.S. Cl. ..... 101/366; 101/364; 101/365

(58) Field of Search ..... 101/363, 364, 101/365, 366, 349.1, 350.1, 480

(56) References Cited

U.S. PATENT DOCUMENTS

| | | | | |
|---|---|---|---|---|
| 2,695,561 A | * | 11/1954 | Huck | 101/366 |
| 3,065,693 A | * | 11/1962 | Neal et al. | 101/366 |
| 3,739,721 A | * | 6/1973 | Miarkowaki et al. | 101/366 |
| 4,020,760 A | | 5/1977 | Bryer | |
| 4,281,597 A | | 8/1981 | Dressler | |
| 5,018,444 A | | 5/1991 | Schumacher et al. | |
| 5,027,706 A | | 7/1991 | Niemiro et al. | |
| 5,038,681 A | | 8/1991 | Hultberg et al. | |
| 5,129,320 A | | 7/1992 | Fadner | |
| 5,168,807 A | | 12/1992 | Elia et al. | |
| 5,182,993 A | | 2/1993 | Shiba et al. | |
| 5,315,930 A | | 5/1994 | Niemiro | |
| 5,412,577 A | | 5/1995 | Sainio et al. | |
| 5,460,091 A | | 10/1995 | Mazzenga et al. | |
| 5,472,324 A | * | 12/1995 | Atwater | 417/423.8 |
| 5,482,448 A | * | 1/1996 | Atwater et al. | 417/492 |
| 5,526,745 A | | 6/1996 | Uera | |
| 5,575,208 A | | 11/1996 | Kirihara | |
| 5,689,425 A | | 11/1997 | Sainio et al. | |
| 5,823,111 A | | 10/1998 | McManamon | |
| 5,957,051 A | * | 9/1999 | Atwater | 101/366 |
| 5,967,044 A | | 10/1999 | Marschke | |
| 6,029,574 A | | 2/2000 | Richards | |
| 6,318,259 B1 | | 11/2001 | Chou et al. | |
| 6,516,721 B1 | | 2/2003 | Voge | |

* cited by examiner

*Primary Examiner*—Daniel J. Coliila
*Assistant Examiner*—Leo T. Hinze
(74) *Attorney, Agent, or Firm*—Vedder Price Kaufman & Kammholz

(57) ABSTRACT

A printing press having a number of identical inking systems for delivering ink to said press. The individual inking systems comprises an ink source including an ink reservoir held under a positive pressure. The ink travels from the manifold through a valve mechanism and to one or more piston mechanisms which undergo rotary and reciprocating motion, and thence to the ink outlets. Two piston and single-piston mechanisms are described.

19 Claims, 8 Drawing Sheets

INK PUMP WITH ROTATING RECIPROCATING PUMP AND ROTARY VALVE

This is a continuation-in-part of my earlier filed Application Ser. No. 10/461,147 filed on Jun. 13, 2003.

BACKGROUND OF THE INVENTION

The present invention relates to inking systems for printing presses, and more particularly to various adjustable phasing systems for ink valves and ink pumps in series and which adjust the ink flow separately to each column of printing coming from a press. According to various embodiments of the invention, the ink may flow from 0% to 100% of a selected maximum for each column across the web.

The manner in which the ink flow is adjustably phased comprises an ink input, a phasing unit or rotary valve for the input, an injector pump unit in series with the phasing unit, and an ink output line which delivers the ink to the roller and then to the paper. One advantage of this system is that no return is made of ink which is not used; some systems pump a certain amount of ink, and this amount is divided into one portion that flows to the paper while the remainder of the ink is returned to the reservoir. Another system of the invention uses a single rotary piston with two flats, spaced axially along its length and an adjustable barrel plus appropriate passages in the barrel housing. This system uses an open yoke to allow the piston to have an intermittent motion to avoid creating a vacuum in the piston.

Known inking systems include piezoelectrically driven ink flow valves which open and close to a degree which is dependent on the need for ink at that time. Owing to the problem of variable flow rate through the valves, these systems require delicate timing, have significant expense and complexity, and have other problems as well.

In view of these and other shortcomings of the prior art, it is an object of the present invention to provide several improved, adjustable ink flow control systems and methods.

Another object is to provide a plurality of so-called phased injectors for the ink used in a modern offset press, with the injectors being either of the single-piston type, or the two-piston type.

A further object is to provide a rotary valve in series with a positive displacement pump for each column of print provided in an offset printing press, whether the pumps are a single member with two flats or reliefs or are two members each with a single flat or relief.

Another object is to provide systems in which the ink used flows from the valves to the pumping units or injectors to the press rollers, all without being returned to the ink reservoir.

A still further object is to provide, for each column of print, different methods of controlling ink flow using phase control between a rotary valve or barrel assembly and using a positive displacement pump in series with each other.

A further object is to provide methods and apparatus having easily adjustable controls for adjusting the effective phase angle between the rotary valve and the positive displacement pumps in a press inking system, whereby the exact amount of ink desired may be delivered to each of the various columns to be printed by the press.

A still further object is to provide a system without a return circuit for ink which is not desired to be used.

A further object is to provide a system of inking wherein the flow rate in view of the viscosity of the ink can be adjusted for, and in which ink viscosity is ultimately immaterial as far as the correct or desired amount of ink flow is concerned.

Another object, in one embodiment, is to take advantage of a rotary valve having a rotary-valve core and a sleeve with intake and outlet ports in series with a positive displacement pump using a reciprocable and rotatable piston and using one such valve and one pump in series for every column of printed matter in the press.

Another object of the invention is to provide three different versions of somewhat similar apparatus and which operate in similar but not identical ways, and in which each apparatus ultimately accomplishes a related novel result.

A still further object is to provide one embodiment wherein the phase control is accomplished by rotating the valve core in the rotary valve and holding the sleeve in a fixed position.

A further object is to provide another embodiment wherein phase control is achieved by means of rotating the sleeves rather than the cores of the rotary valves relative to each other.

Another object is to provide a phase control unit wherein one sleeve is inclined relative to its drive input, thereby providing the eccentric motion necessary for piston rotating and reciprocating motion.

Another object is to provide an ink supply system wherein the rotary valve and the pumping unit comprises two flats or notches in a single piston rather than two flats or notches in two separate pistons.

A still further object is to provide an embodiment of a rotary mechanism which uses an open slot yoke rather than a bearing in a yoke for rotating the piston and allowing slack in the piston movement under certain conditions.

Yet another object is to provide a barrel and a having a body with appropriate passages for ink demanded by the rotary valves or pistons.

These and other objects and advantages and the manner of their attainment will become more clearly apparent when reference is made to the following detailed description of the invention set forth by way of example and to the accompanying drawings wherein like reference numbers indicate corresponding parts throughout.

DETAILED DESCRIPTION

Although the invention may be embodied in various forms, a description will be given of several forms of the invention, all of which allow adjustment to be made individually of the quantity of ink delivered to each column of an offset press. These are typically six or eight columns each, for a page to be printed by a module of the inking system of the invention. With four pages, therefore, there are 24 to 32 modules, each of the type described herein. In one instance, the sleeve or cylinder of the rotary valve upstream (as the ink flows) of the piston may be rotated to a variety of positions, thus varying the ink flow from 0% to 100%. In another embodiment, the core of the rotary valve is advanced or retarded relative to the cycle of the piston on the injector pump, thus altering the flow between 0% and 100%, and all percentages there between. In still another form, a single piston having two flats or cutouts is used with an appropriate cylinder block and passages, and with phasing controls for the ink supply.

In one typical embodiment, the present invention consists of an inking system for a multi-column printing press. The apparatus typically includes an ink or fountain roller which is one of many rollers (not shown) and an ink spreader, which is the last component upstream of the fountain roller. In another embodiment, the overall results are the same, but the mechanism of delivering the ink is different.

Figure 13:
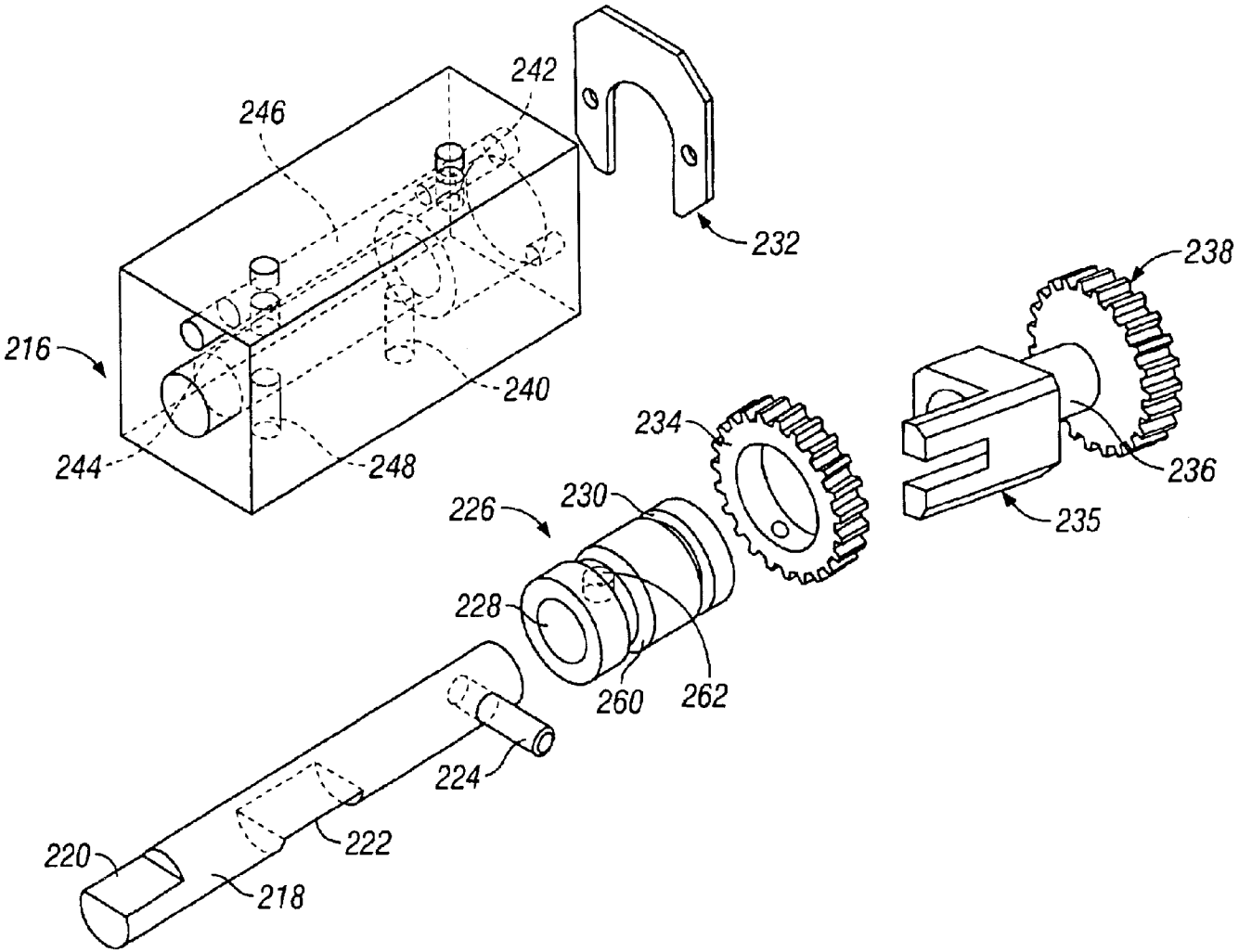
FIG. 13 is an exploded prospective view of the inking apparatus of FIG. 12, showing a single piston with two flats cut into the piston on opposite sides thereof and showing the moveable barrel, the barrel retainer, the valve body including the bore and various passages, the phasing gear and the drive mechanism for the pistons, including the open yoke.

Referring now to FIGS. 1–11 of the drawings in greater detail, there is shown in FIG. 13, certain elements of a printing press generally designated 20 including several rollers 22 (only one shown) a spreader generally designated 24 and upper and lower members 26, 28 between which is the ink orifice 30. In addition, there is shown a flex hose 32 leading to the spreader 24 and taking ink from an outlet passage 34 in a cylinder block generally designated 36. The block 36 also includes an intermediate or transfer passage 38 and an inlet passage 40 which is connected to an ink manifold 42 serving a number of identical stations generally designated 44. The ink supply contained in the manifold 42 is kept under a moderate pressure, say 20–40 psi, which remains effective throughout the operation of the press 20. This arrangement therefore insures that the ink will flow through the various passages, valves, etc. whenever they are open.

A principal component of an injector pump generally designated 46 which resides in bore 47 is a cylinder 48 having one closed end 54, an inlet port 50 communicating with the transfer passage 38 and an outlet port 52 communicating with the outlet passage 34.

The piston 56 moves with both a reciprocating motion and a rotary motion and includes a top surface 58, a notch 60 chordwise of the piston 56 and a lower end 58 with a yoke pin 61, connecting the piston 56 to the yoke 62 through a ball unit 64 held in the arm 66 of the yoke 62. The yoke arm 66 is offset by a portion 68 and a rotary, driven extension 70. The extension 70 has a gear 72 designed to mesh with and be rotated by a gear 74 which drives a rotary valve core shaft 76. An offset gear 77 takes the driving force and rotates the valve core shaft 76 on which the gear 74 is positioned. This supplies the force to the gear 72. A clutch arrangement generally designated 78 is provided so that if there is an unintentional stopping force applied to one shaft or gear, forces will not be transmitted to the other gear. The squared off extension 104 enables the valve core shaft 76 to be turned by hand, if necessary.

The rotary valve core shaft 76 includes a cylindrical head portion 80 and a notch 82. The valve core shaft 76 rotates within a contoured cylinder generally designated 84 which is held in place in a bore 85 within the block 36 by a pair of snap rings 86, 88. There are at least 3 O-rings 90, 92, 94 surrounding the cylinder 84 and sealing it against leakage. These are necessary because of relative movement between cylinder 84 and the block 36 The end portion 96 of the cylinder 84 is squared off so as to receive a driving force from drive motor 106 (FIG. 1) for the cylinder 84. The cylinder 84 is preferably driven by the motor 106 (FIG. 1) having a shaft 108 driving a timing belt or timing chain pulley 110 which engages a belt or chain 1112 acting on a pulley 114, which is keyed or otherwise attached to the squared-off portion 96 of the movable cylinder 84.

An important feature of the invention is that the cylinder 84 can be rotated to a limited extent within the block 36 so as to be in phase, partially in phase, or out of phase with the injector pump 46, thus achieving the phase control in question and which will be illustrated in detail later. The expressions "in phase", "out-of-phase" or the like relate to the rotation of the rotary valve/cylinder with the counterpart piston. Thus, if the rotary valve and piston are exactly synchronized, the piston/valve are said to be "in phase":. If there are differences, the two are, to a greater or lesser extent, "out-of-phase". With the maximum out-of-phase condition, no ink is admitted to the piston; with any degree less that completely "out-of-phase", the piston takes on a corresponding amount of ink, varying from none or almost none to being filled completely.

Figure 1:
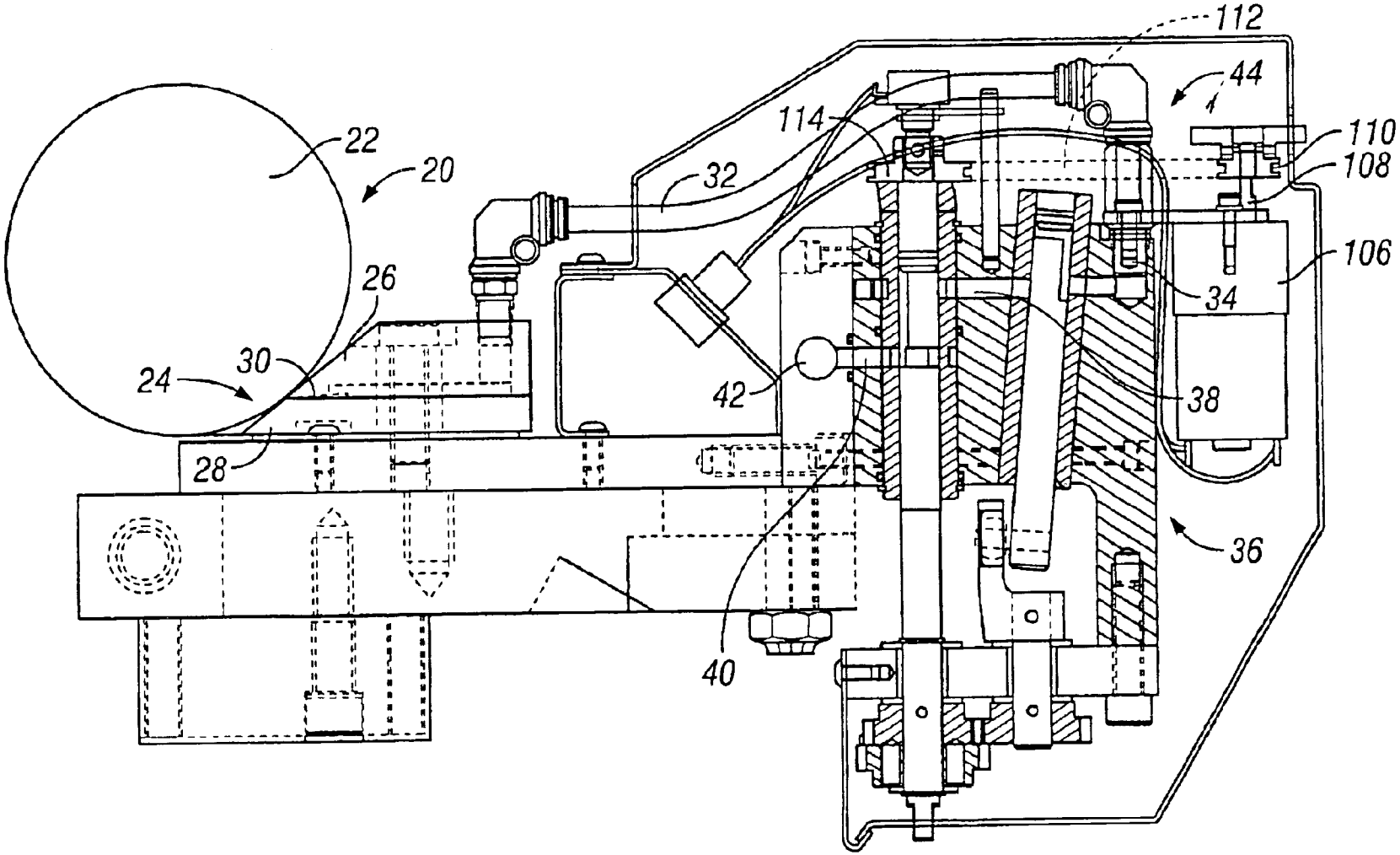
FIG. 1 is a vertical sectional view of one form of printing press showing ink flow through one of many identical inking stations and showing a portion of a fountain roller, a rotary phasing valve, a positive-displacement injector pump and associated clutch and drive gears, an ink inlet line, an ink outlet line, a spreader, and other elements of one embodiment of the invention.
Figure 2:
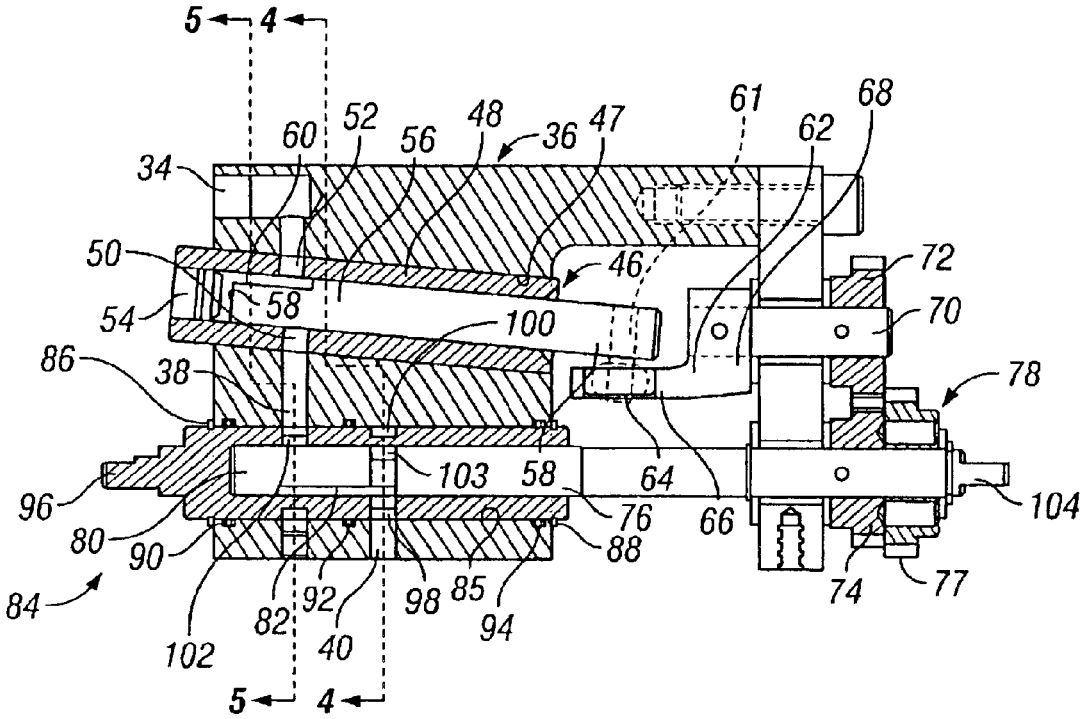
FIG. 2 is an enlarged view of a rotary ink valve including the sleeve which is movable about its cylindrical axis and an ink injector pump in the embodiment of FIG. 1.

The cylinder 84 includes an inlet port 98 which communicates with a circumferential groove 100 in the valve core shaft 76. The groove 100 communicates with the port 98 which in turn communicates with the passage 40 and the ink supply generally designated 42 (FIG. 1). The cylinder generally designated 84 also includes an outlet port 102 communicating with the transfer passage 38.

The preferred drive system for the valve core shaft 76 and the piston 56 occurs by way of a motor or the like (not shown) which drives the gear 77 and hence the valve core shaft 76, with the valve core shaft 76 in turn driving the injector pump piston 46 through the gears 74,72.

Figure 4:
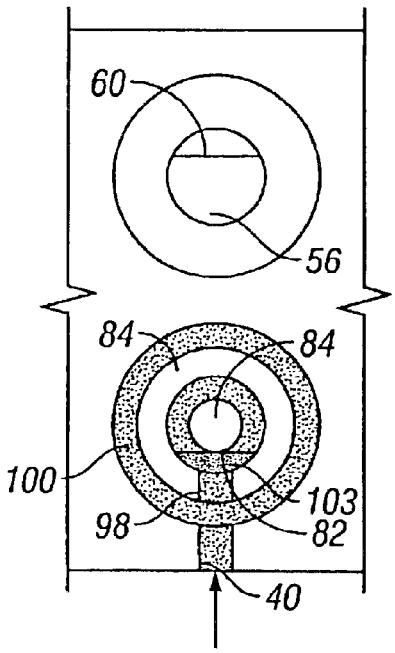
FIG. 4 is a schematic vertical sectional view, taken along lines 4—4 of FIG. 2, showing the cylinder, valve, core and piston of FIG. 2 in one position.

Referring now to FIGS. 4–11, a plurality of cycles are shown, with the ink and valve in various positions. FIG. 4 shows ink in the passage 40 passing into and around the groove 100, and thereafter through the port 98 and into the groove 103 in the valve core 84. The flat or notch 82 in the valve 84 faces toward the passage 40. At this time, the injector pump is shown with the notch 60 in the piston 56 facing away from the inlet. There is at this position of the pumps no passage 38 connecting the valve and piston. Hence, the valve and piston are out-of-phase.

Figure 5:
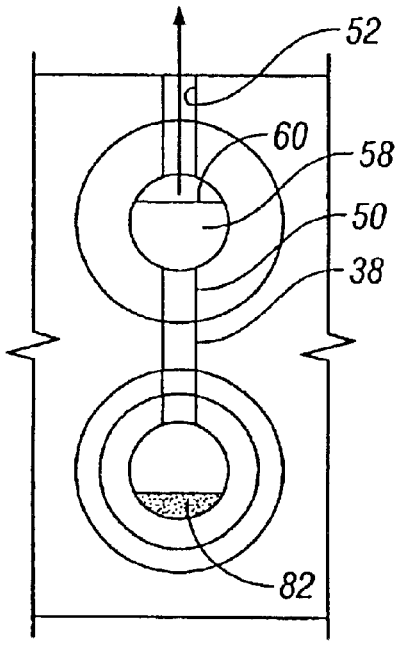
FIG. 5 is a schematic vertical sectional view of parts of the core and piston, taken along lines 5—5 of FIG. 2.
Figure 3:
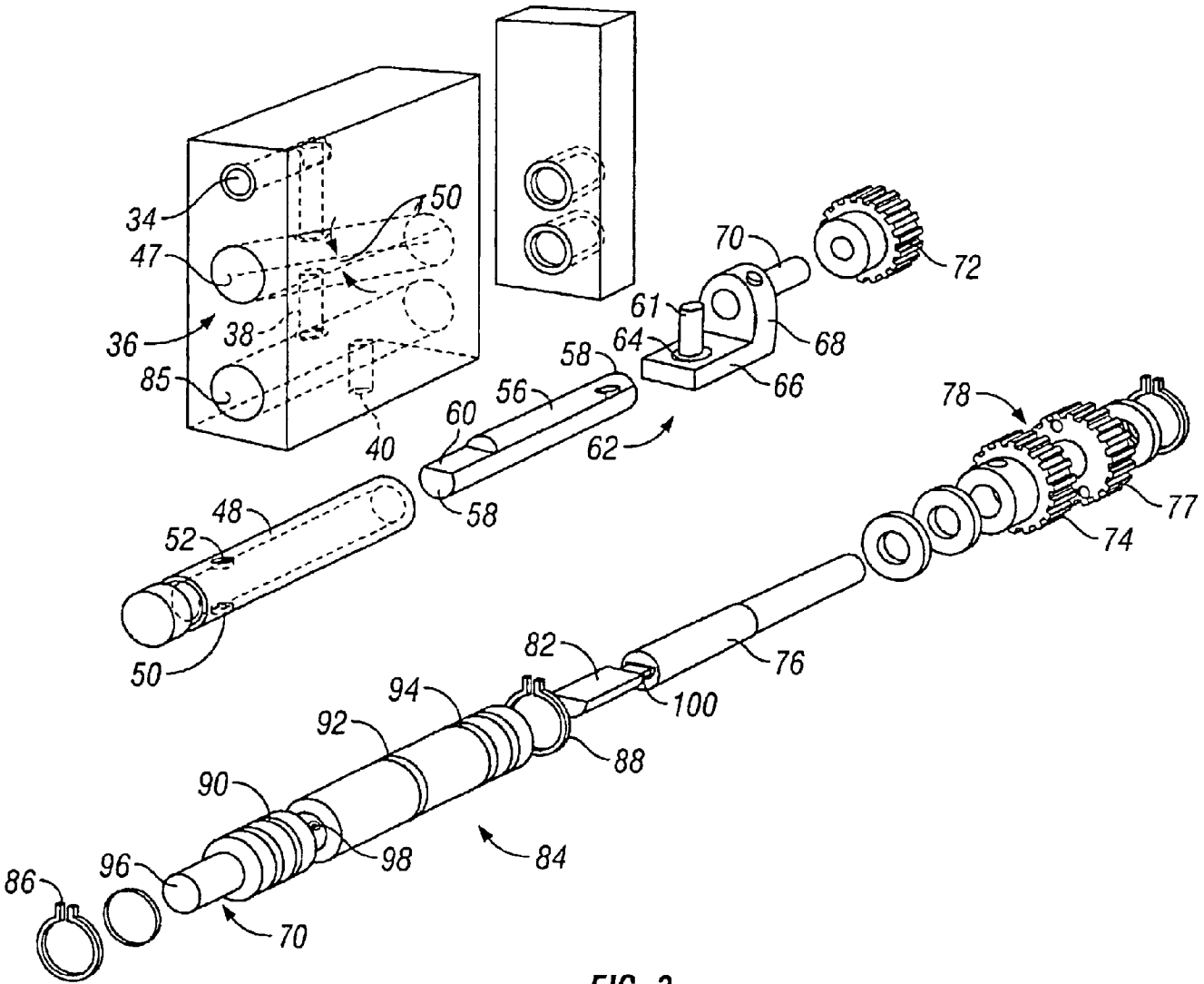
FIG. 3 is an exploded perspective view of the rotary valve of FIG. 1 and the injector pump, a portion of the yoke and valve core drive and the housing for these parts.

Thus, FIG. 5 shows the rotary valve notch 82 being full of ink I but not aligned with passage 38. The injector pump piston is also arranged with the notch 60 facing the outlet port 52, so no ink can flow from the injector.

Figure 6:
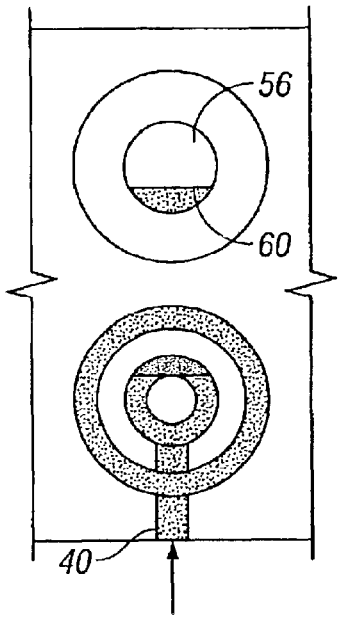
FIG. 6 is a view of the elements schematically shown in FIG. 4, only showing the components in a different position.
Figure 7:
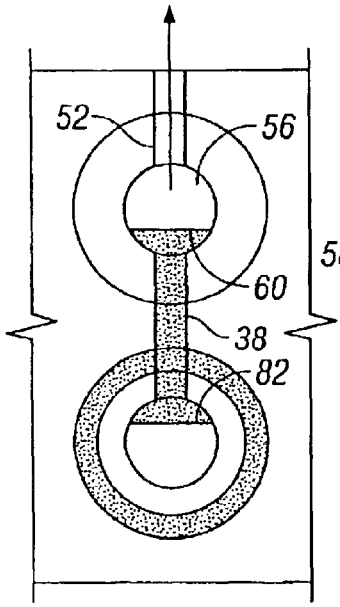
FIG. 7 is a view similar to FIG. 5, but showing the components in another position.
Figure 8:
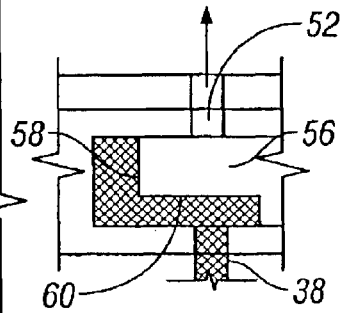
FIG. 8 is a greatly enlarged horizontal sectional view of the piston of FIG. 7 in one position thereof.

In FIGS. 6 and 7, the loading cycle is shown. Here the notch 82 on the rotary valve core shaft 76 faces toward the passage 38, and the notch 60 on the injector 56 faces the notch 82. FIG. 7 shows the ink passing from these notches 82, 60. At the same time, FIG. 8 shows the piston at its lowermost position, that is, at the bottom of its stroke. However, the notch is still facing away from the passage 52. When the piston completes its upstroke, the notch 60 will be facing the passage 52, and the upward movement of the piston will deliver the full charge of ink to the passage 34 and ultimately to the spreader 30.

Figure 9:
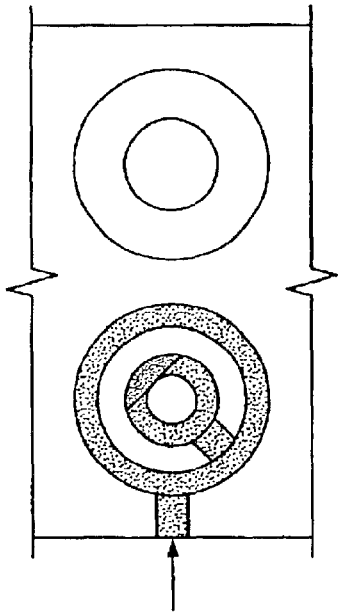
FIG. 9 is a schematic view similar to FIGS. 4 and 6, showing another position of the components.
Figure 10:
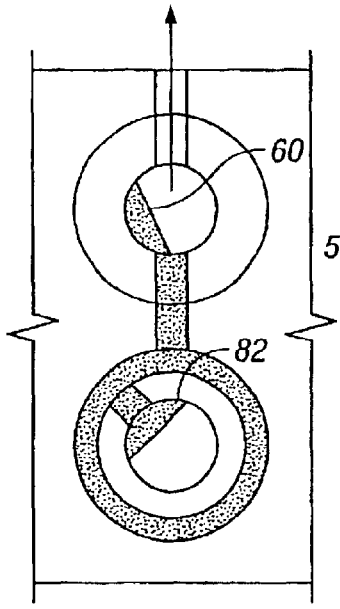
FIG. 10 is a view similar to FIGS. 5 and 7, showing the components in still another position.
Figure 11:
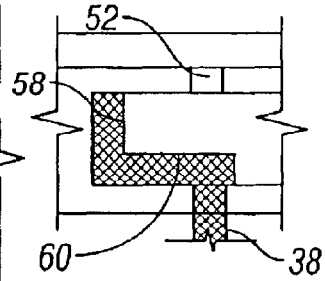
FIG. 11 is a horizontal sectional view of the piston similar to FIG. 8, only showing the piston in a different position.

FIGS. 9–11 show a partial fill in the injector pump 56. FIG. 9 shows partial filling and FIG. 10 shows there is a phased relationship between the rotary valve and the injector pump. The timing of the events is such that the two notches 60, 82 are somewhat in and somewhat out of phase. FIG. 10 shows this out-of-phase relationship. At the same time, the stroke of the injector pump is such that it less than completely fills the volume in the notch and above the head 58. Consequently, the injection pump 60 transfers a reduced amount of ink to the spreader and roller.

The barrel 84 can be moved in very fine increments, permitting very close adjustment of ink flow.

Another embodiment differs from the first embodiment described drive only by changing the phase relationship described by causing the rotary valve to pass into and out of exact synchronism by rotating the valve core of the rotary valve instead of rotating the cylinder in which the valve moves. In this case, the valve stem opposite the clutch end of the core would engage a drive belt or chain, with a clutch 78 being released during this time so as to permit relative movement between the piston 56 and the valve core 80.

Figure 12:
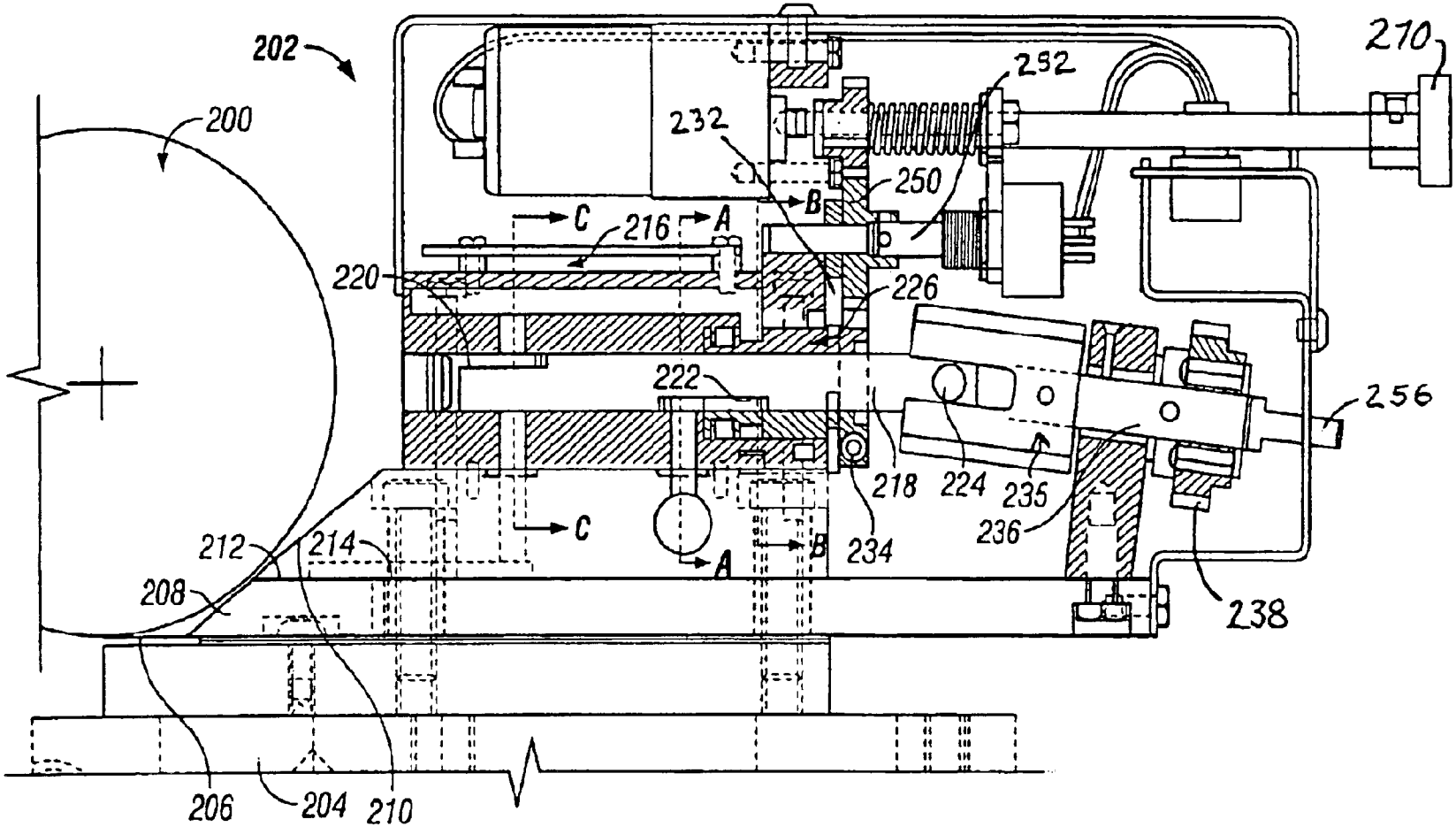
FIG. 12 is a vertical sectional view of a modified version of the ink pump of the invention.

Another embodiment is shown in FIGS. 12 and 13, and its functioning is diagrammatically illustrated in FIGS. 14–25. Referring now to FIGS. 12 and 13, there is shown a roller generally designated 200 having ink fed to it by a member of the individual apparatus generally designated 202 of the invention. The ink feed apparatuses 202 each includes a lower block 204, a spreader 206, an intermediate member 208 and a top member 210, defining between the members 208, 210 an ink outlet or orifice 212 which is connected to a horizontal ink passage 214.

The horizontal ink passage 214 is one of several in the body or cylinder block generally designated 216. An important main component of the invention is a rotatable and reciprocable piston 218 in the form of a right circular cylinder having two flats 220, 222 therein as well as a drive pin 224 near one end. Besides the piston 218, the cylinder block also accommodates a rotatable barrel generally designated 226, having a central body 228 and an end groove 230 for accommodating a barrel retainer generally designated 232. The barrel 226 fits within the cylinder block generally designated 216 and is able to be rotated by a phasing gear generally designated 234, to which it is keyed. A groove 260 extends all the way around in the barrel and includes a phasing port or radial opening 262 which admits ink to a greater or less extent, depending on its phase or position, as will be explained later.

Reciprocation and rotation of the piston 218 is accomplished through the drive pin 224 which is engaged by a yoke generally designated 235 driven by a shaft 236 which in turn engages a drive gear 238. The axis of rotation of the shaft 236 is inclined relative to the rotational axis of the piston 218, to account for both reciprocating and rotary motion.

Referring now to the body or cylinder block 216, this unit 216 has a lower, inlet passage 240, two vertical transfer passages 242, 244 separated by a horizontal transfer passages 246 and a vertically extending outlet passage 248. The outlet passage 248 communicates with the horizontal passage portion 214 of the ink outlet.

Other components include a gear 250 and a drive mechanism including a shaft 252 for rotating the phasing gear 234 and hence the barrel 226. A drive gear 238 rotates the shaft 236; a squared off end 256 enables the shaft to be manually rotated and hence to be set or reset as desired.

Figure 14:
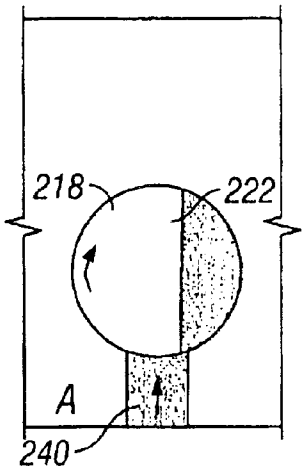
FIG. 14 is an end sectional view of the ink inlet passage of FIG. 12 and one position of the piston showing the beginning of the fill cycle, taken along lines of A—A of FIG. 12.
Figure 15:
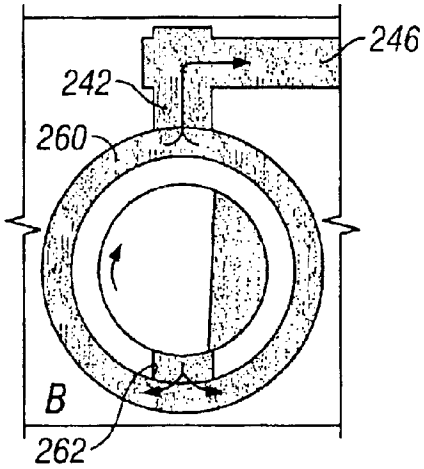
FIG. 15 is an end sectional view of the transfer of passage and the piston of FIG. 12, taken along lines B—B of FIG. 12.
Figure 16:
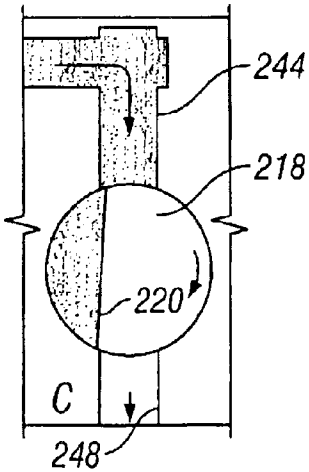
FIG. 16 is an end sectional view of the transfer passage at outlet passage and piston of FIG. 12, taken along lines C—C thereof.

Referring now to the operation of certain elements of the embodiment shown generally in FIGS. 12 and 13, the operation of these elements is shown schematically in FIGS. 14–25. In FIGS. 14–16, the ink is shown filling the passage 240, in which it is confined under a slight pressure, and traveling upward until it fills the area defined by the rear flat 222 on the piston 218. The ink also flows around and fills the circular passage formed by the groove 260 in the barrel 226. The ink then also flows into and through the passage 242 and the passage 246. Referring particularly now to FIG. 16, the ink flows from passage 246 to passage 244, and starts to fill the notch or flat 220 in the piston 218. The outlet passage 248 is still just free of a new charge of ink at this time.

Figure 17:
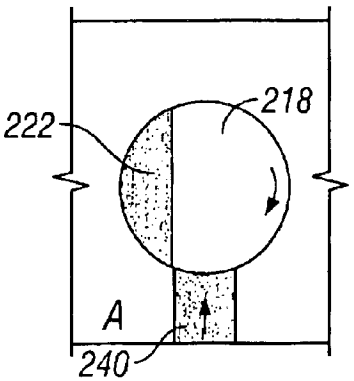
FIGS. 17-19 are figures similar to FIGS. 14–16, showing the end of the fill cycle.
Figure 18:
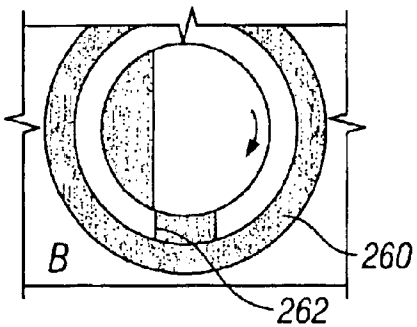
Figure 19:
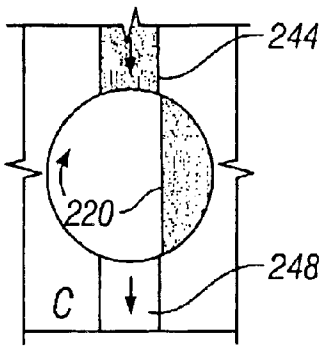

FIGS. 17–19 show the end of the fill cycle, showing the flat 222 in the piston 218 being completely filled and cutting off further flow from the lower passage 240. FIG. 18 shows the groove 260 completely filled, and FIG. 19 shows the front flat 220 filled with ink and ready to allow ink to flow into the outlet passage 248; the next bit of rotation of the piston will cause ink to flow in the passage 248, and continue to flow until the flat has passed out of registry with the passage 248.

Figure 22:
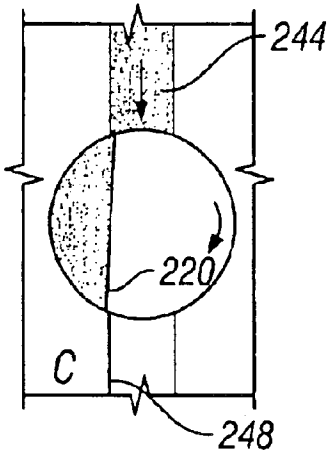
FIGS. 20–22 are views similar to FIGS. 14–16, but showing the beginning of a half flow fill cycle.
Figure 21:
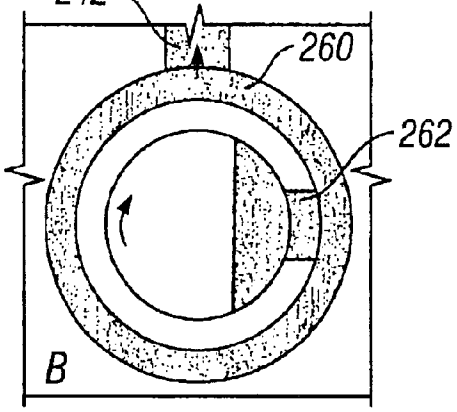
Figure 20:
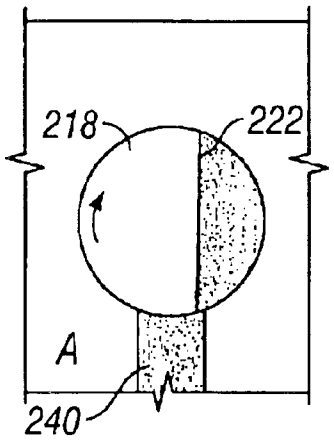

Referring now to FIGS. 20–22, there is shown a position of the barrel which is rotated 90° from its former position. Here the piston flat 222 is just beginning to fill from the passage 240 and the barrel is rotated so as to be in phase with the flat 222. FIG. 22 shows the flat 220 in position where it is just starting to be filed from passage 244.

Figure 25:
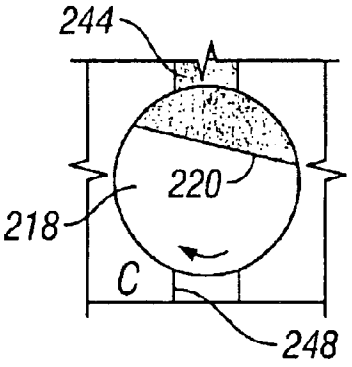
FIGS. 23–25 are views similar to FIGS. 20–22, but showing the end of a half flow fill cycle.
Figure 24:
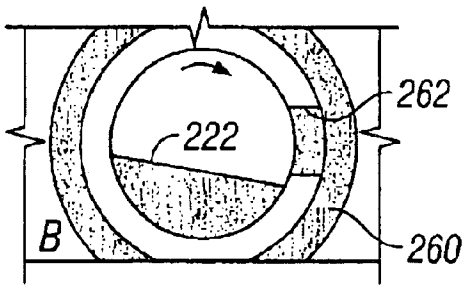
Figure 23:
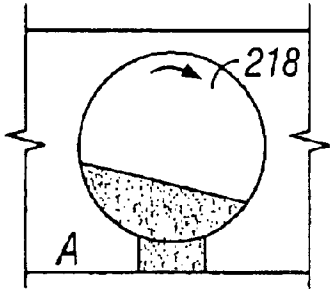

FIG. 23-25 shows the end of the fill cycle with the phasing gear set at a one-half fill, or 3 o'clock, position. Consequently, the flat 222 begins to acquire a one-half load of ink. The phasing gear has moved this phasing port 262 to the 3 o'clock position, and FIG. 25 shows the flat 220 taking on half of the maximum fill. Subsequently, this one-half portion of ink will be sent to the outlet port 248.

One key to the operation of this single piston form of the invention is the phasing port 262 and circumferential groove in the adjustable barrel 226. When the phasing port 262 in the barrel groove 260 is moved to a 180° or straight up position, the intake of ink is completely blocked out, and no ink can flow regardless of the notch positions in the piston. When the port is moved slightly, a small amount of ink may pass because the notch 222 and the barrel are almost completely out of phase. As the phasing port 262 approaches the lowermost position, the barrel and the piston flat are almost completely in phase, and larger amounts of ink are transferred.

The single piston version of the ink supply apparatus has one feature that is different from its counterpart. Because the drive arrangement for the piston must accommodate a partial vacuum in the operating cycle when the flat or notch 222 in the piston is not full, the yoke which drives the piston must be free from pulling a vacuum in portions of the cycle.

Therefore, the yoke 234 has a closed end 235 and an open end 237. This allows the drive pin 224 a degree of freedom it would not otherwise have. Of course, the yoke might also have a closed end, but it should not have a bearing or other fixed-position means of restraining the piston. The ink is supplied from a manifold that serves a number of individual inking systems. This ink is always kept under pressure, usually 10–40 psi, although in the case of more viscous inks, the pressure may be as high as about 100 psi.

Other elements of the apparatus are known to those skilled in the art. A rotatable knob 270, for example, is one method of adjusting the gears that move the barrel to an infinite number of positions between fully open and fully closed. This knob 270 is operated either remotely or by hand, depending on the degree to which the ink supply devices are automated. As pointed out, the rotary valve of the first two embodiments perform the same function as the barrel in the later embodiment, namely, the single piston apparatus. Although the two-position embodiment operates on the same general principle, the single-piston embodiment is less expensive and is more reliable. Other advantages are known to those skilled in the art.

It will thus be seen that the present invention provides several novel and effective inking system having a number of advantages and characteristics, including those specifically pointed out and others which are inherent in the invention.

What is claimed is:

1. An inking system for a multi-column press, said system including an ink manifold, and for each column to be inked, a cylinder block having an inlet passage, a rotary valve assembly including a cylinder closed at one end, a rotary valve core having a notch therein, inlet and outlet passages in said cylinder, a transfer passage in said cylinder block, and a positive displacement injector pump having a piston able to undergo rotatable and reciprocable motion within a closed end cylinder having an inlet port and an outlet port therein, said cylinder block also having an ink outlet passage, a yoke connected to said injector pump piston, means for imparting rotary and reciprocating motion to said pump piston, and means for rotating said rotary valve cylinder so as to cause said intake port on said cylinder to register fully with said inlet passage in said cylinder block and also to cause said port to register less than fully with said inlet passage in said cylinder block, whereby the amount of ink pumped by said injector pump may be varied.

2. An inking system as defined in claim 1 wherein said means for rotating said cylinder comprise means for rotating said cylinder sufficiently to completely cut off registration between said inlet passage in said cylinder block and said inlet port in said cylinders.

3. An inking system as defined in claim 1 wherein said rotating means include a motor and a drive system operatively connected to said cylinder.

4. An inking system as defined in claim 1 wherein said rotary valve assembly includes O-ring seals between said rotary valve cylinder and said cylinder block to prevent leakage of ink from said cylinder while allowing said cylinder to move.

5. An inking system as defined in claim 1 wherein said injector pump and said rotary valve core are driven by gears mating with each other.

6. An inking system for a multi-column printing press, said system including an ink inlet line, a rotary valve assembly including a hollow cylindrical sleeve, a rotatable valve core, inlet and outlet passages in said cylindrical sleeve, a transfer passage, an ink injector pump including a cylindrical sleeve, a rotatable and reciprocable piston, an ink inlet passage communicating with said transfer passage on said rotary valve, an outlet passage communicating with said outlet of said injector sleeve, a yoke driving said piston, said yoke and said valve core being driven by drive means, and means for varying the phase relationship of said rotary valve with said injector.

7. An inking system as defined in claim 6 wherein said means for varying the phase relationship between said valve core and said injector comprises a mechanism for rotating said hollow cylindrical sleeve.

8. An inking system as defined in claim 6 wherein said means for varying the phase relationship between said valve core and said injector comprises a mechanism for rotating said valve core with a slightly greater or slightly less rotational velocity with respect to the rotational velocity of said injector piston.

9. A printing press having an inking system for delivering ink to said press, said inking system comprising, in combination, an ink source including an ink reservoir held under a positive pressure, a cylinder block having an inlet passage, a transfer passage and an outlet passage, a rotary valve assembly including a cylinder with a closed end, inlet and outlet passages and a rotary valve core having a notch therein positioned in said cylinder, a positive displacement injector pump assembly including a cylinder with a closed end and inlet and outlet passages therein, a rotatable and reciprocable piston having a notch therein and being driven by a yoke for creating a reciprocating motion of said piston, rotary drive means for said yoke and said valve core, and means for altering the phase relation of said rotary valve assembly with said injector pump assembly, whereby the amount of ink entering said pump may be varied.

10. An inking system for a multi-column press, said system including an ink manifold, and an ink spreader for each column to be inked, and, between said manifold and said spreader, a cylinder block having a longitudinal passage with one closed end for an elongated piston which undergoes rotary and reciprocating motion, an ink inlet near a first longitudinal end of said piston, a transfer passage from said first end of said piston to a second end of said piston, and an outlet passage directed toward said ink spreader, a cylindrical piston having a notch on each of said first and second ends and on opposite lateral sides thereof, and a valve in the form of a cylindrical barrel surrounding said first end of said piston, said cylindrical barrel being rotatable approximately 180°, a radial passage in said barrel and a groove surrounding said barrel including said radial passage, and means for moving said barrel between positions so as to move said radial passage into varying degrees of registration with said notch on said first end of said piston, whereby the amount of ink fed to said press may be varied.

11. An inking system as defined in claim 10 wherein said rotary and reciprocating motion is created by a rotary yoke whose axis is inclined with respect to the axis of the piston, said yoke being constructed and arranged to allow free movement for at least a portion of its rotational cycle.

12. An inking system as defined in claim 10 wherein said means for moving said barrel between positions comprises a gear mechanism adapted to undergo rotary motion.

13. An inking system as defined in claim 10 wherein said elongated piston includes near said first end a drive pin engageable by a yoke, said yoke allowing lost motion between said piston and said yoke.

14. An inking system as defined in claim 10 wherein said ink manifold is pressurized.

15. An inking system as defined in claim 10 wherein said ink manifold is kept under a pressure from about 10 psi to about 100 psi.

16. An inking system for a multi-column press, said inking system including an ink inlet line, an ink transfer line, an ink outlet line, said inlet and outlet lines having flow therein controlled by flat-containing piston portions capable of reciprocating and rotating motion, the improvement comprising a rotary valve cylinder in series with said flats and able to be moved between positions of substantially complete registration to substantially no registration with one flat on said piston, whereby the flow of said ink to said outlet line may be varied through a broad range.

17. An inking system as defined in claim 16 wherein said rotary valve cylinder lies between said flats on said piston.

18. An inking system as defined in claim 16 wherein said inking system includes a single piston having two flats thereon.

19. An inking system as defined in claim 16 wherein said inking system includes two pistons, a piston forming a part of said rotary valve and an injector piston.

* * * * *